US011539113B2

(12) United States Patent
Lee et al.

(10) Patent No.: US 11,539,113 B2
(45) Date of Patent: Dec. 27, 2022

(54) ELECTRONIC DEVICE

(71) Applicant: GETAC TECHNOLOGY CORPORATION, Hsinchu County (TW)

(72) Inventors: Kun-Cheng Lee, Taipei (TW); Min-Yu Wang, Taipei (TW); Juei-Chi Chang, Taipei (TW)

(73) Assignee: GETAC TECHNOLOGY CORPORATION, Hsinchu County (TW)

( * ) Notice: Subject to any disclaimer, the term of this patent is extended or adjusted under 35 U.S.C. 154(b) by 0 days.

(21) Appl. No.: 17/356,344

(22) Filed: Jun. 23, 2021

(65) Prior Publication Data

US 2021/0408665 A1 Dec. 30, 2021

Related U.S. Application Data

(60) Provisional application No. 63/044,206, filed on Jun. 25, 2020.

(30) Foreign Application Priority Data

Nov. 18, 2020 (CN) ..... 202011297077.1

(51) Int. Cl.
*H01Q 1/22* (2006.01)
*H01Q 1/24* (2006.01)
*H01Q 3/34* (2006.01)

(52) U.S. Cl.
CPC ..... *H01Q 1/2266* (2013.01); *H01Q 3/34* (2013.01)

(58) Field of Classification Search
CPC ..... H01Q 1/22; H01Q 1/2266; H01Q 1/24; H01Q 3/34; H01Q 3/30
See application file for complete search history.

(56) References Cited

U.S. PATENT DOCUMENTS 10,608,321 B2 * 3/2020 Jiang ..... H01Q 1/528
2010/0073243 A1 * 3/2010 Ayala Vazquez ..... H01Q 1/02 343/702

FOREIGN PATENT DOCUMENTS

CN 111081658 A * 4/2020
JP 2017228982 A * 12/2017

* cited by examiner

*Primary Examiner* — Tho G Phan

(57) ABSTRACT

An electronic device provided by an embodiment of the present invention includes a host device, a display device, a first array antenna, a second array antenna and a third array antenna. A side of a base shell of the host device has an accommodating slot. An upper cover shell of the display device has a first and a second sides opposite to each other, wherein the first and second sides have a first and a second accommodating spaces. The first array antenna is arranged in the accommodating slot, and has a first beam facing a first axis. The second array antenna is arranged in the first accommodating space, and has a second beam facing a second axis. The third array antenna is arranged in the second accommodating space, and has a third beam facing a third axis. The first, the second and the third axes are different from one another.

8 Claims, 7 Drawing Sheets

ELECTRONIC DEVICE

CROSS-REFERENCE TO RELATED APPLICATIONS

The present application claims the benefit of U.S. Provisional Patent Application No. 63/044,206, filed on Jun. 25, 2020, the disclosure of which is hereby incorporated by reference herein in its entirety. The present application further claims priority to a CN Patent Application No. 202011297077.1, filed on Nov. 18, 2020, the disclosure of which is also hereby incorporated by reference herein in its entirety.

BACKGROUND OF THE INVENTION

Field of the Invention

The present invention relates to an electronic device, and more particularly to an electronic device in which a plurality of array antennas are arranged in an upper cover shell and in a base shell.

Description of the Prior Art

Accompanied by the thriving development of wireless broadband networks and mobile communication technologies, diversified electronic products (e.g., cellphones, tablet computer and laptop computers) having a wireless communication function are extensively used in mass, so that the number of antenna elements also increases with the evolving communication technologies. However, the space inside an electronic device is not expanded as the number of antenna elements increases. In addition, distances between antenna elements or between antenna elements and other electronic elements of an electronic product are also significantly reduced, further aggravating coupling issues between the antenna elements or with other electronic elements, as well as affecting the performance and communication quality of antennas, resulting in numerous new formidable challenges for designers.

SUMMARY OF THE INVENTION

In view of the above, an electronic device provided according to an embodiment of the present invention includes a host device, a display device, a first array antenna, a second array antenna and a third array antenna. The host device includes a base shell, the base shell has a side, and the side has an accommodating slot. The display device is pivotally connected to the host device, and turns relative to the host device. The display device includes an upper cover shell, wherein the upper cover shell has a first side and a second side opposite to each other, the first side has a first accommodating space, and the second side has a second accommodating space. The first array antenna is arranged in the accommodating slot, and has a first beam facing a first axis. The second array antenna is arranged in the first accommodating space, and has a second beam facing a second axis. The third array antenna is arranged in the second accommodating space, and has a third beam facing a third axis. The first axis, the second axis and the third axis are different from one another.

In one embodiment of the present invention, the side further includes a heat dissipation support member arranged in the accommodating slot, and the first array antenna is arranged on the heat dissipation support member.

In one embodiment of the present invention, the first side further includes a first heat dissipation support member arranged in the first accommodating space, and the second array antenna is arranged on the first heat dissipation support member; the second side further includes a second heat dissipation support member arranged in the second accommodating space, and the third array antenna is arranged on the second heat dissipation support member.

In one embodiment of the present invention, the first array antenna, the second array antenna and the third array antenna are mmWave antennas.

In one embodiment of the present invention, the upper part of the base shell is defined as a virtual reference plane, and a projection range of the accommodating slot on the virtual reference plane partially overlaps with a projection range of the first accommodating space on the virtual reference plane.

In one embodiment of the present invention, the base shell further includes a third accommodating space and a heat dissipation element. The heat dissipation element is arranged in the third accommodating space, and a projection range of the third accommodating space on the virtual reference plane partially overlaps with the projection range of the first accommodating space on the virtual reference plane.

In one embodiment of the present invention, the side further includes an air outlet, which is located at a lower part of the accommodating slot and is in communication with the third accommodating space.

In one embodiment of the present invention, the electronic device further includes a first radio-frequency (RF) signal processing module, a second RF signal processing module and a third RF signal processing module. The first RF signal processing module is arranged in the accommodating slot and coupled to the first array antenna, and transmits or receives a first RF signal through the first array antenna. The second RF signal processing module is arranged in the first accommodating space and coupled to the second array antenna, and transmits or receives a second RF signal through the second array antenna. The third RF signal processing module is arranged in the second accommodating space and coupled to the third array antenna, and transmits or receives a third RF signal through the third array antenna.

In one embodiment of the present invention, the host device further includes a substrate arranged in the base shell; the electronic device further includes a baseband signal processing module arranged on the substrate, and coupled to the first RF signal processing module, the second RF signal processing module and the third RF signal processing module through a first RF signal transmission line, a second RF signal transmission line and a third RF signal transmission line, respectively. The baseband signal processing module generates a baseband signal. The first RF signal processing module receives and processes the baseband signal to generate the first RF signal, the second RF signal processing module receives and processes the baseband signal to generate the second RF signal, and the third RF signal processing module receives the baseband signal to generate the third RF signal.

In one embodiment of the present invention, the electronic device further includes a phase control module. The phase control module is arranged on the substrate, and is coupled to the first RF signal processing module, the second RF signal processing module and the third RF signal processing module through a first signal control line, a second signal control line and a third signal control line, respectively. The phase control module generates a first phase control signal, a second phase control signal and a third phase control signal, to control a beam direction of the first beam, a beam direction of the second beam and a beam direction of the third beam, respectively.

In the electronic device provided according to the embodiment of the present invention, the plurality of array antennas are arranged in the upper cover shell and base shell, and the placed position and the inclining angle of each of the array antennas are adjusted so that each of the array antenna has a beam substantially facing a specific axis. Moreover, the beam directions and/or the inclining angles of the plurality of array antennas are adjusted according to the signal quality and/or signal strength received from the specific axes, so that the plurality of array antennas can accurately point toward a base station, preventing signal interruption from the base station. Accordingly, the electronic device and the base station are provided with a stable connection quality and a higher transmission rate in between.

The description above is merely a summary of the technical solutions of the present invention. To understand the technical means of the present invention with better clarity, be able to carry out implementations based on the disclosure of the detailed description and more easily appreciate the above and other objects, features and advantages of the present invention, preferred embodiments are described in detail with the accompanying drawings below.

DETAILED DESCRIPTION OF THE EMBODIMENTS

In some wireless communication systems (e.g., a mmWave communication system), multiple antennas can be used between a base station and a user equipment (e.g., a laptop computer) to transmit or receive signals. An electronic device provided according to an embodiment of the present invention is applicable to an electronic device (e.g., a laptop computer) having a wireless communication function.

Figure 1A:
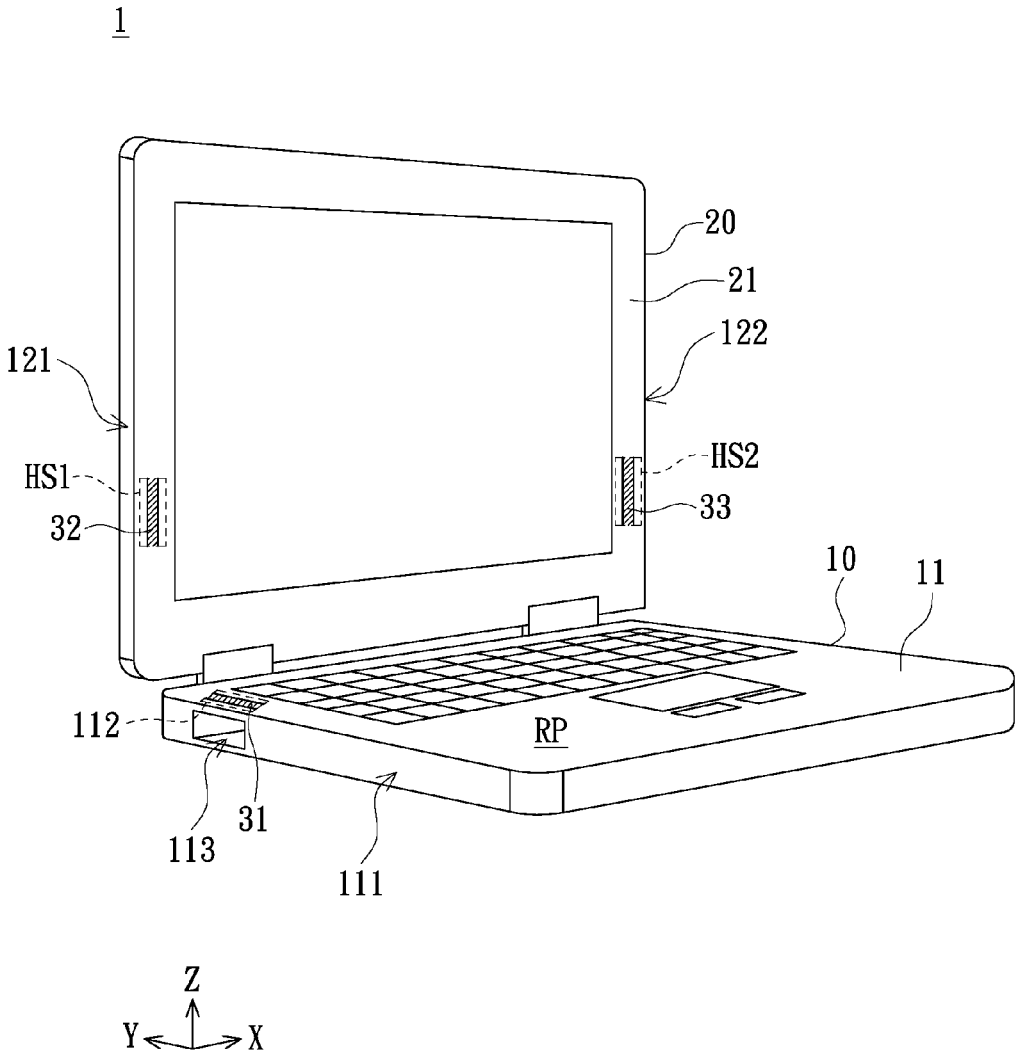
FIG. 1A is a schematic diagram of an electronic device according to an embodiment of the present invention.
Figure 1B:
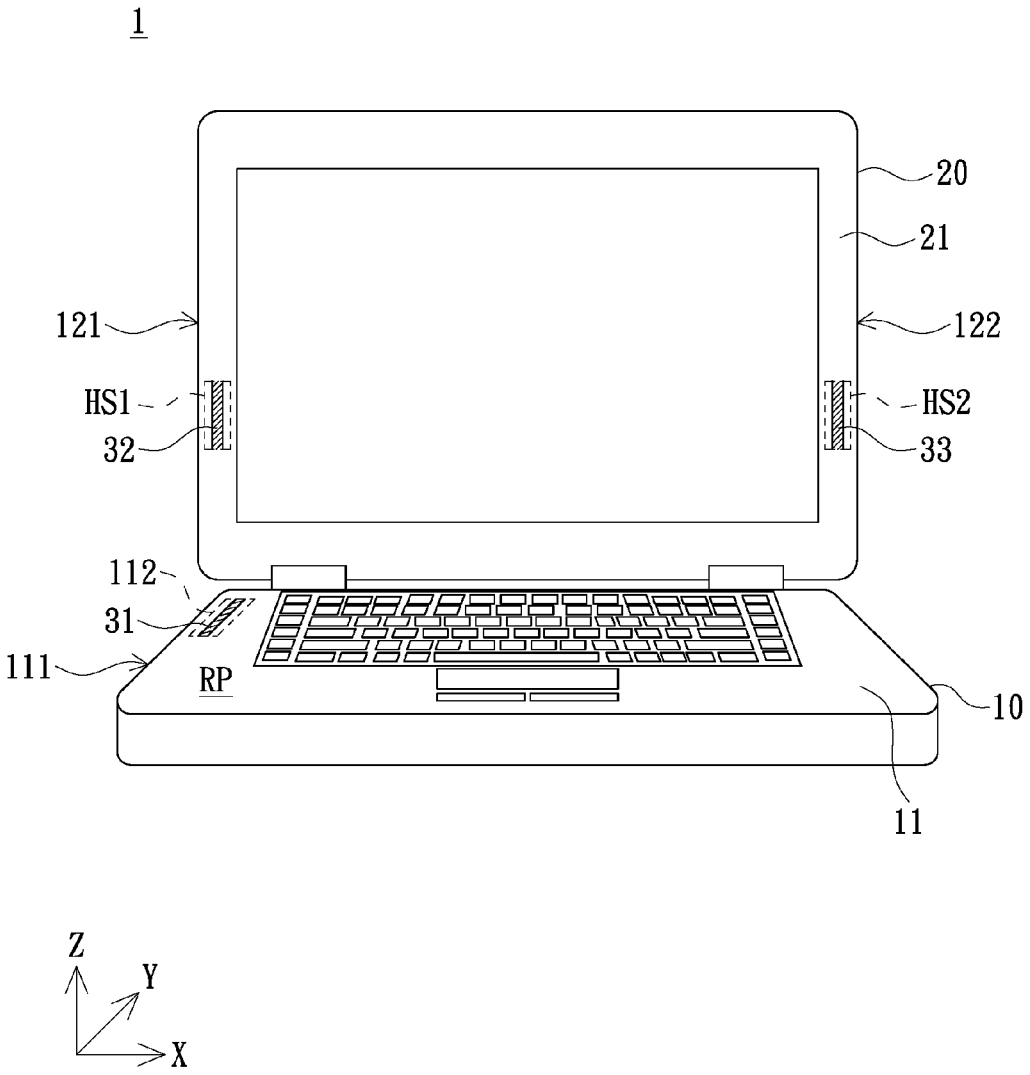
FIG. 1B is another schematic diagram of an electronic device according to an embodiment of the present invention.

FIG. 1A shows a schematic diagram of an electronic device according to an embodiment of the present invention. FIG. 1B shows another schematic diagram of an electronic device according to an embodiment of the present invention. Referring to FIG. 1A and FIG. 1B, an electronic device 1 provided according to an embodiment of the present invention includes a host device 10 and a display device 20. The host device 10 includes a base shell 11, the base shell 11 has a side 111, and the side 111 has an accommodating slot 112 for accommodating electronic components. The display device 20 is pivotally connected to the host device 10, so that the display device 20 can turn or rotate relative to the host device 10 to render the electronic device 1 to be in an open or closed state. The display device 20 includes an upper cover shell 21. The upper cover shell 21 has a first side 121 and a second side 122 opposite to each other, wherein the first side 121 has a first accommodating space HS1 for accommodating electronic components, and the second side 122 has a second accommodating space HS2 for accommodating electronic components.

The electronic device 1 further includes a first array antenna 31, a second array antenna 32 and a third array antenna 33. The first array antenna 31, the second array antenna 32 and the third array antenna 33 are preferably mmWave array antennas, e.g., 1×4 mmWave array antennas (each including four antenna elements having the same structure and size, e.g., patch antennas), for emitting (i.e., to transmitting) or receiving radio waves. The radio waves generated by the first array antenna 31, the second array antenna 32 and the third array antenna 33 can perform, toward a selected axis (e.g., the X-axis, Y-axis or Z-axis), beam scanning in specific directions by means of phase control, so as to detect the direction or position of a base station (not shown) near the electronic device 1 at all times.

For example, assuming that the scanning angle range is positive/negative (±) 60 degrees, the beams generated by the first array antenna 31, the second array antenna 32 and the third array antenna 33 can cover a communication range of approximately 120 degrees. In order to detect the position of a base station at all times, while scanning, the electronic device 1 adjusts in real time the beam directions of the first array antenna 31, the second array antenna 32 and the third array antenna 33 preferably according to the signal quality (e.g., a connection rate) and/or the signal strength (e.g., a received signal strength indicator (RSSI)), so that the array antennas can accurately point to the base station to thereby prevent signal interruption from the base station. Accordingly, the electronic device 1 and the base station are provided with a stable connection quality and a higher transmission rate in between.

Figure 2A:
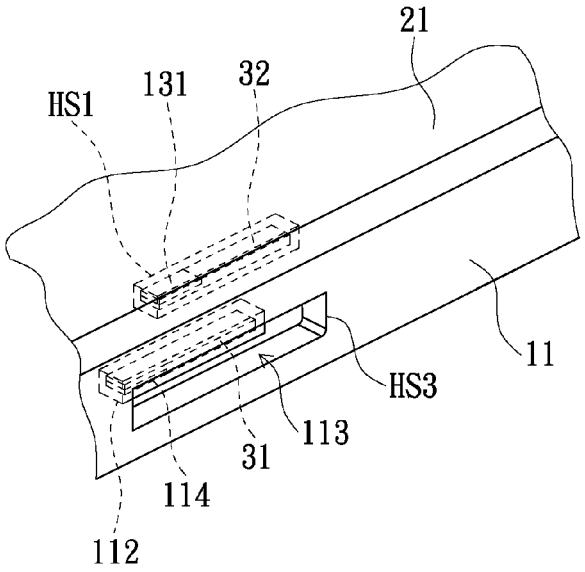
FIG. 2A is a partial schematic diagram of an electronic device when closed according to an embodiment of the present invention.
Figure 2B:
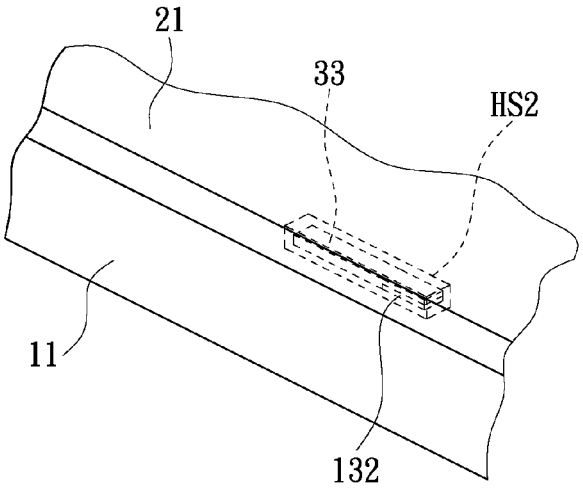
FIG. 2B is another partial schematic diagram of an electronic device when closed according to an embodiment of the present invention.

FIG. 2A shows a partial schematic diagram of an electronic device when closed according to an embodiment of the present invention. FIG. 2B shows another partial schematic diagram of an electronic device when closed according to an embodiment of the present invention. Referring to FIG. 2A and FIG. 2B, the first array antenna 31 is preferably arranged in the accommodating slot 112, the second array antenna 32 is preferably arranged in the first accommodating space HS1, and the third array antenna 33 is preferably arranged in the second accommodating space HS2. The upper part of the base shell 11 is defined as a virtual reference plane RP (logically regarded as a plane), which can serve as a reference for radiation surfaces of the foregoing array antennas (i.e., the first array antenna 31, the second array antenna 32 and the third array antenna 33). A projection range of the accommodating slot 112 on the virtual reference plane RP partially overlaps with a projection range of the first accommodating space HS1 on the virtual reference plane RP.

The base shell 11 further includes a third accommodating space HS3 for accommodating various electronic components and a heat dissipation element (e.g., a cooling fan) arranged in the third accommodating space HS3. A projection range of the third accommodating space HS3 on the virtual reference plane RP partially overlaps with the projection range of the first accommodating space HS1 on the virtual reference plane RP.

The side 111 of the base shell 11 further includes an air outlet 113, which is located at a lower part of the accommodating slot 112 and is in communication with the third accommodating space HS3. Moreover, the side 111 of the base shell 11 further includes a heat dissipation support member 114 arranged in the accommodating slot 112. The heat dissipation support member 114 supports the first array antenna 31, and removes heat energy generated during the operation of the first array antenna 31. The first array antenna 31 is preferably arranged on the heat dissipation support member 114, so that the heat energy of the array antenna 31 is transmitted to the heat dissipation support member 114 and removed through the heat dissipation support member 114, thereby reducing the temperature of the first array antenna 31.

The first side 121 of the upper cover shell 21 further includes a first heat dissipation support member 131 arranged in the first accommodating space HS1. The first heat dissipation support member 131 supports the second array antenna 32 and removes heat energy generated during the operation of the second array antenna 32. The second array antenna 32 is preferably arranged on the first heat dissipation support member 131, so that the heat energy generated by the second array antenna 32 is transmitted to the first heat dissipation support member 131 and removed through the first heat dissipation support member 131, thereby reducing the temperature of the second array antenna 32.

The second side 122 of the upper cover shell 21 further includes a second heat dissipation support member 132 arranged in the second accommodating space HS2. The second heat dissipation support member 132 supports the third array antenna 33 and removes heat energy generated during the operation of the third array antenna 33. The third array antenna 33 is preferably arranged on the second heat dissipation support member 132, so that the heat energy generated by the third array antenna 33 is transmitted to the second heat dissipation support member 132 and removed through the second heat dissipation support member 132, thereby reducing the temperature of the third array antenna 33.

Figure 3A:
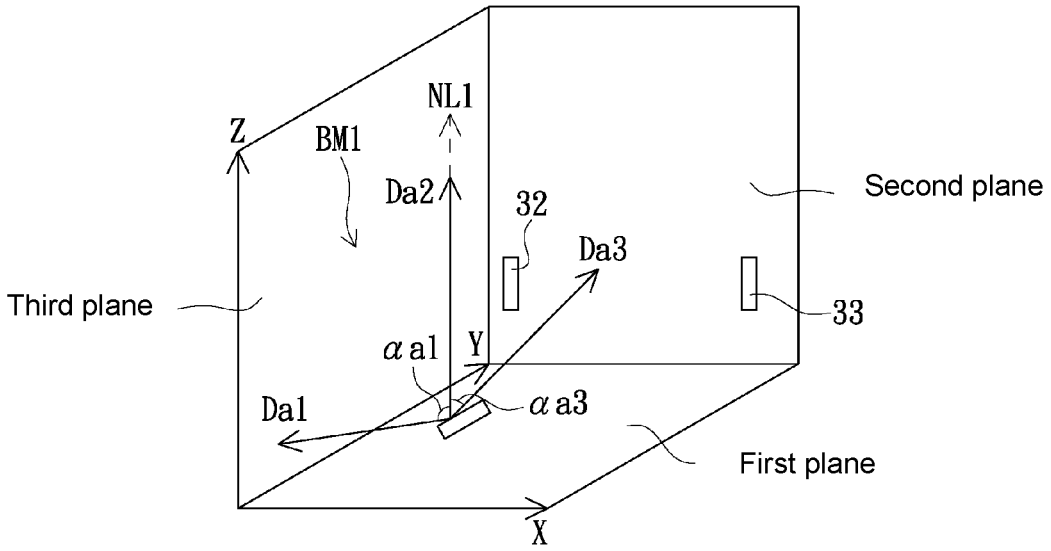
FIG. 3A is a schematic diagram of a beam of a first array antenna according to an embodiment of the present invention.
Figure 3B:
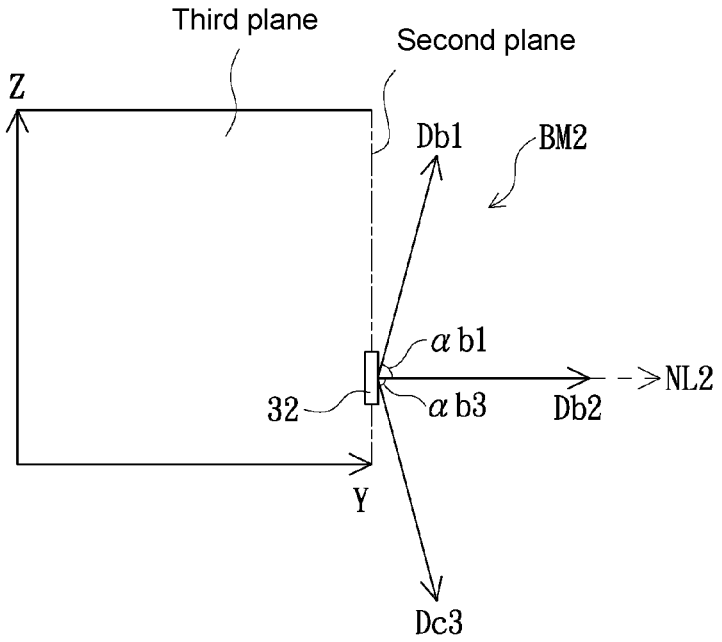
FIG. 3B is a schematic diagram of a beam of a second array antenna according to an embodiment of the present invention.
Figure 3C:
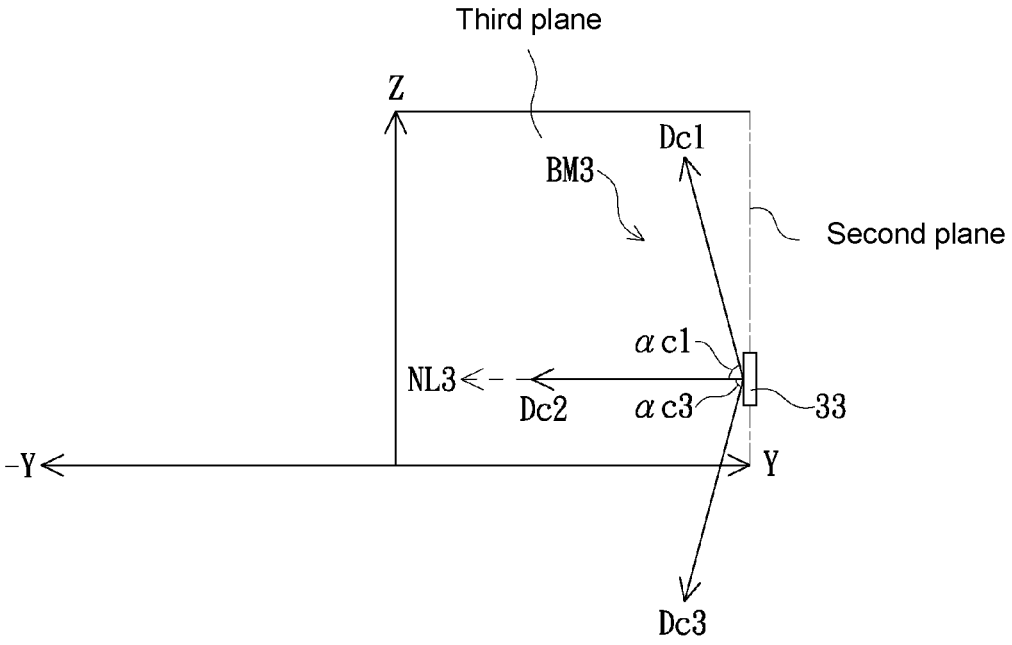
FIG. 3C is a schematic diagram of a beam of a third array antenna according to an embodiment of the present invention.

FIG. 3A shows a schematic diagram of a beam of a first array antenna according to an embodiment of the present invention. FIG. 3B shows a schematic diagram of a beam of a second array antenna according to an embodiment of the present invention. FIG. 3C shows a schematic diagram of a beam of a third array antenna according to an embodiment of the present invention. Referring to FIG. 3A to FIG. 3C, assume that the host device 10 of the electronic device 1 is located on an XY-plane (defined as a first plane) formed by the X-axis and the Y-axis, that is, the host device 10 is parallel to the first plane, and the display device 20 is parallel to an XZ-plane (defined as a second plane) formed by the X-axis and the Z-axis. Thus, the first array antenna 31 has a first beam BM1 substantially facing a first axis (i.e., the Z-axis), the second array antenna 32 has a second beam BM2 substantially facing a second axis (i.e., the Y-axis), and the third array antenna 33 has a third beam BM3 substantially facing a third axis (i.e., the negative Y-axis), wherein the first axis, the second axis and the third axis are different from one another. It should be understood that the first axis, the second axis and the third axis may be any three selected from the X-axis, negative X (−X)-axis, Y-axis, negative Y (−Y)-axis, Z-axis and negative Z (−Z)-axis.

The first array antenna 31 is located on the first plane and generates the first beam BM1 of different angles toward the first axis, wherein the first beam BM1 is substantially parallel to the YZ-plane (defined as a third plane) formed by the Y-axis and the Z-axis, so that the first array antenna 31 can perform scanning on the first plane and substantially toward a direction of the first axis.

The second array antenna 32 is located on the second plane and generates the second beam BM2 of different angles toward the second axis, wherein the second beam BM2 is substantially parallel to the third plane, so that the second array antenna 32 can perform scanning on the second plane and substantially toward a direction of the second axis.

The third array antenna 33 is located on the second plane and generates the third beam BM3 of different angles toward the third axis, wherein the third beam BM3 is substantially parallel to the third plane, so that the third array antenna 33 can perform scanning on the second plane and substantially toward a direction of the third axis.

More specifically, a positive shift angle $\alpha a1$ (e.g., 60 degrees) is present between a beam direction Da1 of the first beam BM1 and a first normal direction NL1 (defined as being perpendicular to the first plane), a shift angle between a beam direction Da2 of the first beam BM1 and the first normal direction NL1 is 0 degree, and a negative shift angle $\alpha a3$ (e.g., −60 degrees) is present between a beam direction Da3 of the first beam BM1 and the first normal direction NL1. In other words, when the scanning angle range of the first array antenna 31 is positive/negative (±)60 degrees, the first array antenna 31 can cover a communication range of 120 degrees.

A positive shift angle $\alpha b1$ (e.g., 60 degrees) is present between a beam direction Db1 of the second beam BM2 and a second normal direction NL2 (defined as being perpendicular to the second plane), a shift angle between a beam direction Db2 of the second beam BM2 and the second normal direction NL2 is 0 degree, and a negative shift angle $\alpha b3$ (e.g., −60 degrees) is present between a beam direction Db3 of the second beam BM2 and the second normal direction NL2. In other words, when the scanning angle range of the second array antenna 32 is ±60 degrees, the second array antenna 32 can cover a communication range of 120 degrees.

A positive shift angle $\alpha c1$ (e.g., 60 degrees) is present between a beam direction Dc1 of the third beam BM3 and a third normal direction NL3 (defined as being perpendicular to the second plane), a shift angle between a beam direction Dc2 of the third beam BM3 and the third normal direction NL3 is 0 degree, and a negative shift angle $\alpha c3$ (e.g., −60 degrees) is present between a beam direction Dc3 of the third beam BM3 and the third normal direction NL3. In other words, when the scanning angle range of the third array antenna 33 is ±60 degrees, the third array antenna 33 can cover a communication range of 120 degrees.

As described above, the electronic device 1 provided according to an embodiment of the present invention dynamically adjusts, according to the signal quality and/or the signal strength received by the first array antenna 31 substantially facing the first axis, the second array antenna 32 substantially facing the second axis and the third array antenna 33 substantially facing the third axis, the beam directions of the first array antenna 31, the second array antenna 32 and the third array antenna 33, so that the first beam BM1, the second beam BM2 and the third beam BM3 can accurately point toward the base station to thereby prevent signal interruption. Accordingly, on the first plane and substantially toward the direction of the first axis, and on the second plane and substantially toward directions of the second axis and third axis, the electronic device 1 can provide a stable connection quality and a higher transmission rate.

Further, the beams generated by the first array antenna 31, the second array antenna 32 and the third array antenna 33 may be affected by the material (e.g., a circuit board, an electronic component, a metal component or a mechanism) of the electronic device 1, and be absorbed, reflected or deviated from a predetermined radiation angle by these substances. Thus, in another embodiment of the present invention, inclining angles of the first array antenna 31, the second array antenna 32 and the third array antenna 33 are adjusted to mitigate the influence of these substances upon the beams.

Figure 4A:
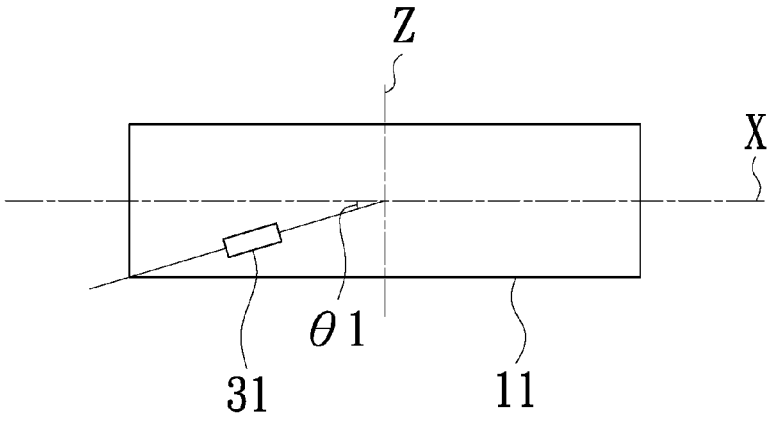
FIG. 4A is a schematic diagram of a first array antenna deviated from a fourth axis according to another embodiment of the present invention.
Figure 4B:
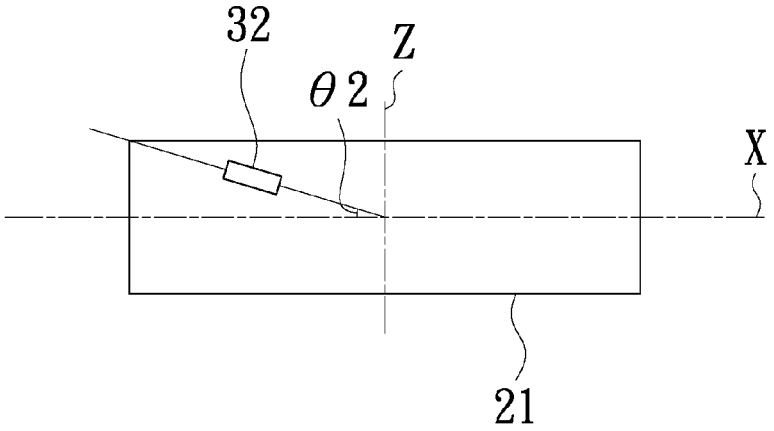
FIG. 4B is a schematic diagram of a second array antenna deviated from a fourth axis when an electronic device is closed according to another embodiment of the present invention.
Figure 4C:
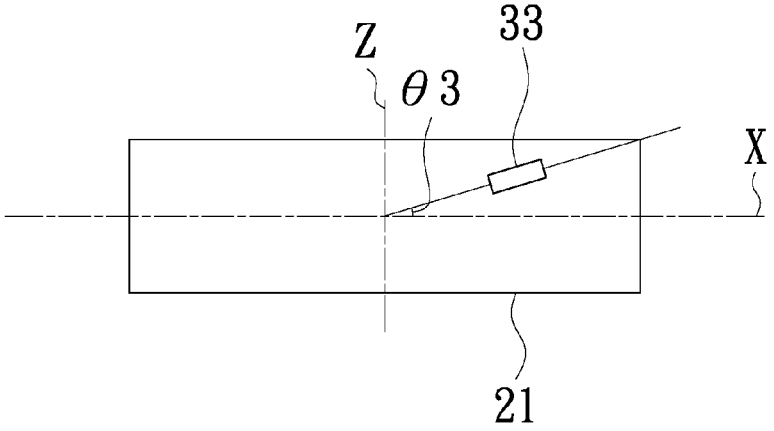
FIG. 4C is a schematic diagram of a third array antenna deviated from a fourth axis when an electronic device is closed according to another embodiment of the present invention.

FIG. 4A shows a schematic diagram of a first array antenna deviated from a fourth axis according to another embodiment of the present invention. FIG. 4B shows a schematic diagram of a second array antenna deviated from a fourth axis when an electronic device is closed according to another embodiment of the present invention. FIG. 4C shows a schematic diagram of a third array antenna deviated from a fourth axis when an electronic device is closed according to another embodiment of the present invention. Referring to FIG. 4A to FIG. 4C, in another embodiment of the present invention, the first array antenna 31, the second array antenna 32 and the third array antenna 33 are deviated from a fourth axis (i.e., the X-axis). Observing from the second plane, the first array antenna 31 inclines by a first angle θ1 relative to the base shell 11 and the fourth axis, such that the first beam BM1 of the first array antenna 31 passes through the top and the upper left of the host device 11 to transmit or receive signals in a mmWave band, wherein the first angle θ1 is preferably between 30 degrees and 45 degrees. Because most of the first beam BM1 is evaded from the display device 20, absorption, reflection or shifting from an original predetermined radiation angle caused by the material (e.g., a liquid display panel, an electronic component, a metal component or a mechanism) of the display device 20 can be significantly reduced.

When the electronic device 1 is closed, observing from the second plane, the second array antenna 32 inclines by a second angle θ2 relative to the upper cover shell 21 and the fourth axis, such that when the electronic device 1 is open, the second beam BM2 of the second array antenna 32 passes through the rear (i.e., the second axis) and the rear left of the display device 20 to transmit or receive signals in a mmWave band, wherein the second angle θ2 is preferably between 30 degrees and 45 degrees. Because most of the second beam BM2 is evaded from the host device 10 and the display device 20, absorption, reflection or shifting from an original predetermined radiation angle caused by the materials (e.g., a liquid display panel, an electronic component, a metal component or a mechanism) of the host device 10 and the display device 20 can be significantly reduced.

When the electronic device 1 is closed, observing from the second plane, the third array antenna 33 inclines by a third angle θ3 relative to the upper cover shell 21 and the fourth axis, such that when the electronic device 1 is open, the third beam BM3 of the third array antenna 33 passes through the front (i.e., the third axis) and the front right of the display device 20 to transmit or receive signals in a mmWave band, wherein the third angle θ3 is preferably between 30 degrees and 45 degrees. Because most of the third beam BM3 is evaded from the host device, the display device 20 and a user (not shown) operating the electronic device 1, absorption, reflection or shifting from an original predetermined radiation angle caused by the materials (e.g., a liquid display panel, an electronic component, a metal component or a mechanism) of the host device 10, the display device 20 and the user of the electronic device 1 can be significantly reduced.

In another embodiment of the present invention, the electronic device 1 further includes a first angle control module (not shown), a second angle control module (not shown) and a third angle control module (not shown), which are coupled to a processor (not shown) and coupled to the first array antenna 31, the second array antenna 32 and the third array antenna 33, respectively, and turn first array antenna 31, the second array antenna 32 and the third array antenna 33, respectively, according to an angle control signal outputted by the processor, so that the first array antenna 31, the second array antenna 32 and the third array antenna 33 incline by a predetermined angle relative to the base shell 11 and the fourth axis. In this embodiment, the first angle control module, the second angle control module and the third angle control module are preferably step motors. The foregoing processor can output the angle control signal to the angle control modules according to the signal quality and/or the signal strength, thereby adjusting the inclining angles of the first array antenna 31, the second array antenna 32 and the third array antenna 33 relative to the base shell 11 and the fourth axis.

Figure 5:
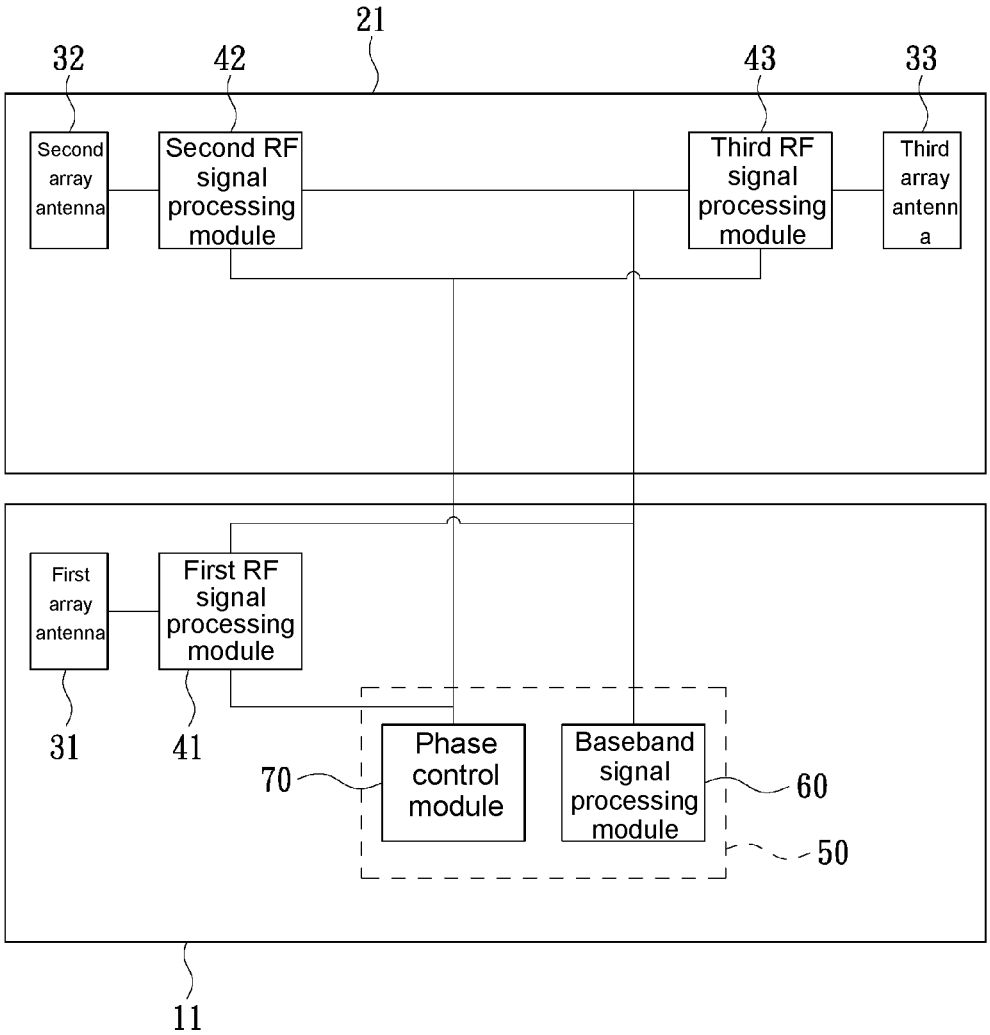
FIG. 5 is a configuration schematic diagram of simplified elements of an electronic device according to an embodiment of the present invention.

FIG. 5 shows a configuration schematic diagram of simplified elements of an electronic device according to an embodiment of the present invention. The electronic device 1 provided according to an embodiment of the present invention further includes a first radio-frequency (RF) signal processing module 41, a second RF signal processing module 42 and a third RF signal processing module 43. The first RF signal processing module 41 is arranged in the accommodating slot 112 and coupled to the first array antenna 31, and transmits or receives a first RF signal through the first array antenna 31. The second RF signal processing module 42 is arranged in the first accommodating space HS and coupled to the second array antenna 32, and transmits or receives a second RF signal through the second array antenna 32. The third RF signal processing module 43 is arranged in the second accommodating space HS2 and coupled to the third array antenna 33, and transmits or receives a third RF signal through the third array antenna 33. Each of these RF signal processing modules may include an antenna switch, a filter, a low-noise input amplifier, a power amplifier, a phase shifter and an RF transceiver. In another embodiment of the present invention, the first RF signal processing module 41 and the first array antenna 31 may be integrated into one module, the second RF signal processing module 42 and the second array antenna 32 may be integrated into one module, and the third RF signal processing module 43 and the third array antenna 33 may be integrated into one module.

The host device 10 provided according to an embodiment of the present invention further includes a substrate 50 (e.g., a printed circuit board) arranged in the base shell 11. The electronic device 1 further includes a baseband signal processing module 60, which generates a baseband signal (i.e., a digital signal) and is arranged on the substrate 50. The baseband signal processing module 60 preferably is coupled to the first RF signal processing module 41, the second RF signal processing module 42 and the third signal processing module 43 through a first RF signal transmission line, a second RF signal transmission line and a third RF signal transmission line, respectively. Further, the first RF signal processing module 41 receives and processes the baseband signal to generate the first RF signal, the second RF signal processing module 42 receives and processes the baseband signal to generate the second RF signal, and the third RF signal processing module 43 receives and processes the baseband signal to generate the third RF signal.

The electronic device 1 provided according to an embodiment of the present invention further includes a phase control module 70 arranged on the substrate 50. The phase control module 70 preferably is coupled to the first RF signal processing module 41, the second RF signal processing module 42 and the third RF signal processing module 43 through a first signal control line, a second signal control line and a third signal control line, respectively. The phase control module 70 generates a first phase control signal, a second phase control signal and a third phase control signal to adjust the beam direction of the first beam BM1, the beam direction of the second beam BM2 and the beam direction of the third beam BM3, respectively. Further, the phase control module 70 may transmit a control signal to the first RF signal processing module 41 through the first signal control line to control the phase shift amount of the shifter of the first RF signal processing module 41, so that the phase of a feed signal of the first array antenna 31 is changed to further adjust the beam direction of the first BM1, thereby achieving the function of scanning back and forth in the first axis by a predetermined scanning angle (preferably ±60 degrees) and allowing the first beam BM1 to cover a 120-degree range. Similarly, the phase control module 70 can adjust the beam directions of the second beam BM2 and the third beam BM3 by the foregoing control method, and associated details are omitted herein.

In conclusion, in the electronic device provided according to the embodiment of the present invention, the plurality of array antennas are arranged in the upper cover shell and base shell, and the placed position and the inclining angle of each of the array antennas are adjusted so that each of the array antenna has a beam substantially facing a specific axis. Moreover, the beam directions and/or the inclining angles of the plurality of array antennas are adjusted according to the signal quality and/or signal strength received from the specific axes, so that the plurality of array antennas can accurately point toward a base station, preventing signal interruption from the base station. Accordingly, the electronic device and the base station are provided with a stable connection quality and a higher transmission rate in between.

While the invention has been described by way of the embodiments, it is to be understood that the invention is not limited thereto. Slightly variations and modifications can be made by a person skilled in the art without departing from the spirit and scope of the present invention. Therefore, the scope of protection of the present invention should be accorded with the broadest interpretation of the appended claims.

What is claimed is:

1. An electronic device, comprising:

a host device, comprising a base shell, the base shell having a side, the side having an accommodating slot;

a display device, pivotally connected the host device, the display device turning relative to the host device, the display device comprising an upper cover shell, wherein the upper cover shell has a first side and a second side opposite to each other, the first side has a first accommodating space and the second side has a second accommodating space;

a first array antenna, arranged in the accommodating slot, the first array antenna having a first beam facing a first axis;

a second array antenna, arranged in the first accommodating space, the second array antenna having a second beam facing a second axis; and a third array antenna, arranged in the second accommodating space, the third array antenna having a third beam facing a third axis;

wherein, the first axis, the second axis and the third axis are different from one another;

wherein an upper part of the base shell is defined as a virtual reference plane, and a projection range of the accommodating slot on the virtual reference plane partially overlaps with a projection range of the first accommodating space on the virtual reference plane; and wherein the base shell further comprises a third accommodating space and a heat dissipation element, the heat dissipation element is arranged in the third accommodating space, and a projection range of the third accommodating space on the virtual reference plane partially overlaps with the projection range of the first accommodating space on the virtual reference plane.

2. The electronic device according to claim 1, wherein the side further comprises a heat dissipation support member arranged in the accommodating slot, and the first array antenna is arrange don the heat dissipation support member.

3. The electronic device according to claim 1, wherein the first side further comprises a first heat dissipation support member arranged in the first accommodating space, and the second array antenna is arranged on the first heat dissipation support member; wherein the second side further comprises a second heat dissipation support member arranged in the second accommodating space, and the third array antenna is arranged on the second heat dissipation support member.

4. The electronic device according to claim 1, wherein the first array antenna, the second array antenna and the third array antenna are mmWave antennas.

5. The electronic device according to claim 1, wherein the side further comprises an air outlet, which is located at a lower part of the accommodating slot and is in communication with the third accommodating space.

6. The electronic device according to claim 1, further comprising:

a first radio-frequency (RF) signal processing module, arranged in the accommodating slot and coupled to the first array antenna, transmitting or receiving a first RF signal through the first array antenna;

a second RF signal processing module, arranged in the first accommodating space and coupled to the second array antenna, transmitting or receiving a second RF signal through the second array antenna; and a third RF signal processing module, arranged in the second accommodating space and coupled to the third array antenna, transmitting or receiving a third RF signal through the third array antenna.

7. The electronic device according to claim 6, wherein the host device further comprises a substrate arranged in the base shell; the electronic device further comprising:

a baseband signal processing module, arranged on the substrate, coupled to the first RF signal processing module, the second RF signal processing module and the third RF signal processing module through a first RF signal transmission line, a second RF signal transmission line and a third RF signal transmission line, respectively;

wherein, the baseband signal processing module generates a baseband signal, the first RF signal processing module receives and processes the baseband signal to generate the first RF signal, the second RF signal processing module receives and processes the baseband signal to generate the second RF signal, and the third RF signal processing module receives and processes the baseband signal to generate the third RF signal.

8. The electronic device according to claim 7, further comprising:

a phase control module, arranged on the substrate, coupled to the first RF signal processing module, the second RF signal processing module and the third RF signal processing module through a first signal control line, a second signal control line and a third signal control line, respectively;

wherein, the phase control module generates a first phase control signal, a second phase control signal and a third phase control signal to adjust a beam direction of the first beam, a beam direction of the second beam and a beam direction of the third beam, respectively.

* * * * *